US010463940B1

(12) United States Patent
Richardson

(10) Patent No.: US 10,463,940 B1
(45) Date of Patent: Nov. 5, 2019

(54) PORTABLE THREE-DIMENSIONAL GOLF SWING TRAINING APPARATUS

(71) Applicant: Roger D. Richardson, Tulsa, OK (US)

(72) Inventor: Roger D. Richardson, Tulsa, OK (US)

( * ) Notice: Subject to any disclaimer, the term of this patent is extended or adjusted under 35 U.S.C. 154(b) by 16 days.

(21) Appl. No.: 15/830,536

(22) Filed: Dec. 4, 2017

(51) Int. Cl.
*A63B 69/36* (2006.01)

(52) U.S. Cl.
CPC ..... *A63B 69/3644* (2013.01); *A63B 2225/09* (2013.01)

(58) Field of Classification Search
CPC . A63B 69/3644; A63B 69/3641; A63B 69/00; A63B 2225/09
See application file for complete search history.

(56) References Cited

U.S. PATENT DOCUMENTS 4,852,881 A * 8/1989 Bellagamba ..... A63B 69/3644 473/216
4,928,974 A * 5/1990 VanKirk ..... A63B 69/3644 473/259
5,069,456 A * 12/1991 Bellagamba ..... A63B 69/3644 473/264
5,474,299 A * 12/1995 Romano ..... A63B 69/3608 473/212
6,843,730 B1 * 1/2005 Bellagamba ..... A63B 69/0057 473/207
7,025,689 B2 * 4/2006 Infalt ..... A63B 69/0057 473/257
7,172,515 B2 * 2/2007 Costa ..... A63B 69/3641 473/261
7,431,661 B1 * 10/2008 Cailey ..... A63B 60/22 473/257
7,980,958 B1 * 7/2011 Ford ..... A63B 69/3608 473/207
8,206,235 B1 * 6/2012 Sardo ..... A63B 69/3623 473/257
8,721,467 B1 * 5/2014 Ackerman ..... A63B 69/3641 473/257
2003/0199330 A1 * 10/2003 Magallanes ..... A63B 69/3676 473/257
2009/0131192 A1 * 5/2009 Rochford ..... A63B 69/3623 473/278
2009/0227385 A1 * 9/2009 Crealese ..... A63B 69/3623 473/218
2010/0120549 A1 * 5/2010 Capesius ..... A63B 69/0057 473/257
2010/0311515 A1 * 12/2010 Hennessey ..... A63B 69/3641 473/257
2012/0264533 A1 * 10/2012 Sasser ..... A63B 69/3641 473/208

(Continued)

*Primary Examiner* — Raleigh W Chiu
(74) *Attorney, Agent, or Firm* — Dennis D. Brown; Brown Patent Law, P.L.L.C.

(57) ABSTRACT

A portable golf swing train apparatus which can be used on the driving range or while playing a round of golf. The apparatus includes a base which can be secured on a golf bag. When the base is positioned on the golf bag, the golf bag provides sufficient support for deploying a swing training structure in an elevated position in front of the golfer. Guiding and alignment structures are provided on the training structure for establishing a swing guiding plane, a club path guiding circle, a correct beginning stance, and correct intermediate downswing positions for the golfer's club, arms and wrists.

9 Claims, 7 Drawing Sheets

(56) References Cited

U.S. PATENT DOCUMENTS

| | | | | |
|---|---|---|---|---|
| 2015/0165298 | A1* | 6/2015 | Williams | A63B 69/3644<br>473/218 |
| 2017/0189783 | A1* | 7/2017 | Woodrow | A63B 69/3641 |
| 2017/0282041 | A1* | 10/2017 | Chiles | A63B 69/3641 |

* cited by examiner

PORTABLE THREE-DIMENSIONAL GOLF SWING TRAINING APPARATUS

FIELD OF THE INVENTION

The present invention relates to golf swing training apparatuses.

BACKGROUND OF THE INVENTION

A need exist for an improved golf swing training apparatus. A need particularly exists for a portable golf swing training apparatus which can be used not only on the driving range, but can also be carried, deployed, and used on the golf course while playing a round of golf. In addition, the portable training device will preferably train the golf to remain in the proper swing plane when using any club while also teaching the correct positions of the club and the golfer's arms and the proper rotation of the golfer's wrists throughout the entire swing.

SUMMARY OF THE INVENTION

The present invention provides a portable, 3-dimensional golf swing training apparatus which addresses all of the needs discussed above. The inventive 3-dimensional training apparatus is adjustable and portable and can fold up to fit inside a golf bag. In addition to being portable, the inventive swing training apparatus can be quickly set up and can be secured and supported in deployed position on the golf bag itself. Consequently, the inventive swing training apparatus can be used not only on the driving range but can also be conveniently carried, deployed, and used on the golf course with a driver or with any iron or wood while playing a round of golf.

In one aspect, there is provided a golf swing training apparatus which preferably comprises: a base structure positionable on a golf bag such that at least a portion of the base structure is on an exterior of the golf bag; a swing position training structure; and a support arm structure which extends from the base structure to the swing position training structure to hold the swing position training structure in an elevated position for use. A proximal end of the support arm structure is preferably pivotably attached or attachable to the base structure for raising and lowering the elevated position of the swing position training structure.

In another aspect there is provided a golf swing training apparatus comprising a swing position training structure which is positionable in an elevated position in front of a golfer and which preferably includes first and second guiding plane members which extend in and define a swing guiding plane for the golfer wherein (a) the first swing guiding plane member is located on a first end portion of the swing position training structure on a backswing side of the golfer, (b) the second swing guiding plane member is located on a second end portion of the swing position training structure on a follow-through side of the golfer, (c) the first swing guiding plane member is elevationally higher than the second swing guiding plane member, (d) the first swing guiding plane member extends upwardly, rearwardly, and inwardly, with respect to the golfer, from the first end portion of the swing position training structure, and (e) the second swing guiding plane member extends upwardly, rearwardly, and outwardly, with respect to the golfer, from the second end portion of the swing position training structure. The swing position training structure of the training apparatus also preferably comprises a club alignment structure located on an intermediate portion of the swing position training structure on a backswing side of a golfer wherein (i) the club alignment structure is for aligning a club held by the golfer at an upper intermediate downswing position and (ii) the club alignment structure extends at upward, rearward, and outward angles with respect to the golfer. The club alignment structure is preferably substantially in alignment with a golf ball on a ground surface in front of the golfer.

Further aspects, features, and advantages of the present invention will be apparent to those of ordinary skill in the art upon examining the accompanying drawings and upon reading the following Detailed Description of the Preferred Embodiments.

DETAILED DESCRIPTION OF THE PREFERRED EMBODIMENTS

Figure 1:
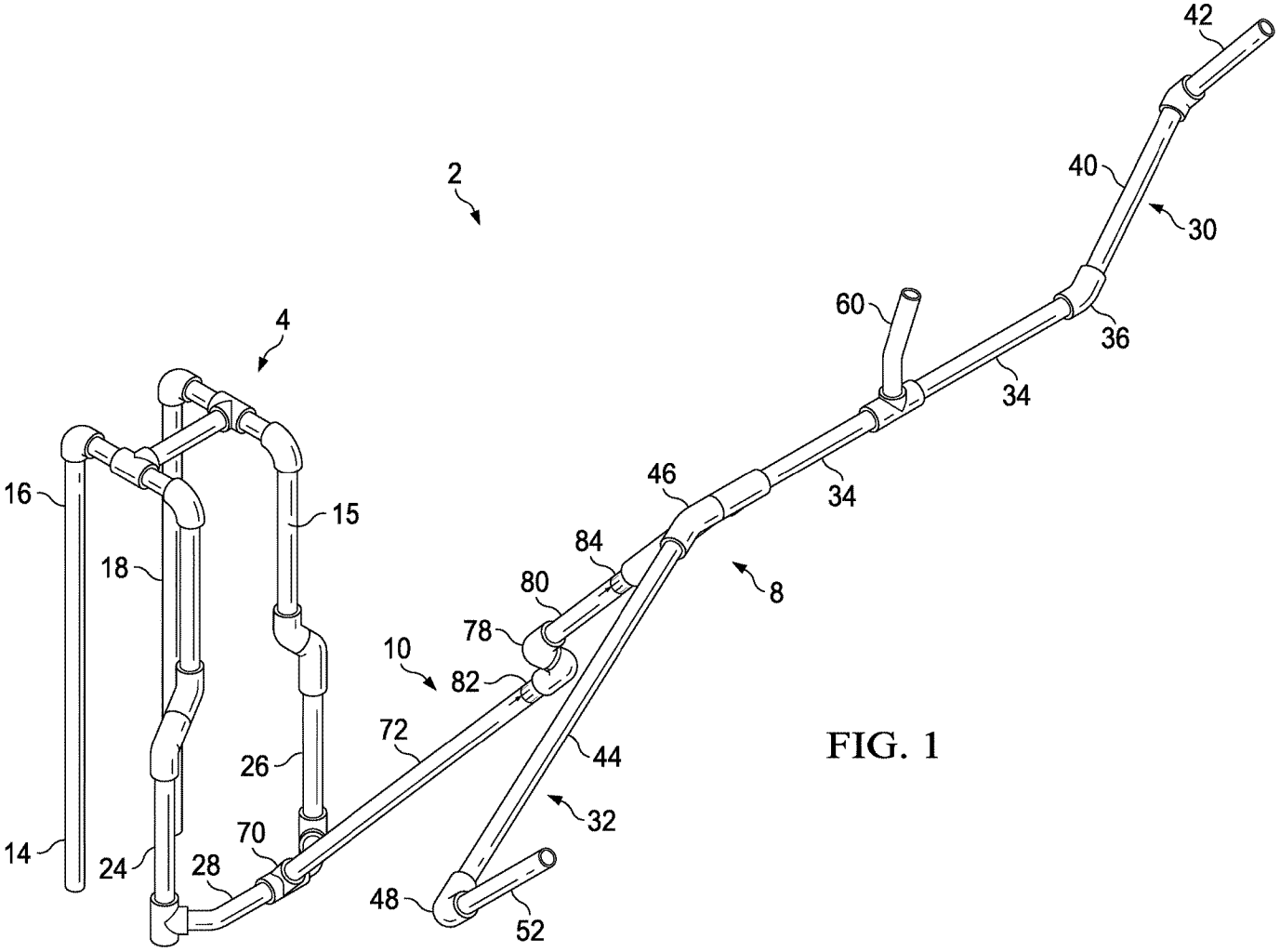
FIG. 1 is a perspective view of an embodiment 2 of the 3-dimensional golf swing training apparatus provided by the present invention.

An embodiment 2 of the inventive 3-dimensional golf swing training apparatus is illustrated in FIGS. 1-7. The inventive apparatus 2 comprises: a base structure 4 which is preferably positionable on a golf bag 6; a swing position training structure 8; and a support arm structure 10 which extends from the base structure 4 to the swing position training structure 8. The support arm structure 10 holds the assembled swing position training structure 8 in an elevated position in front of the golfer 12 for use.

Figure 6:
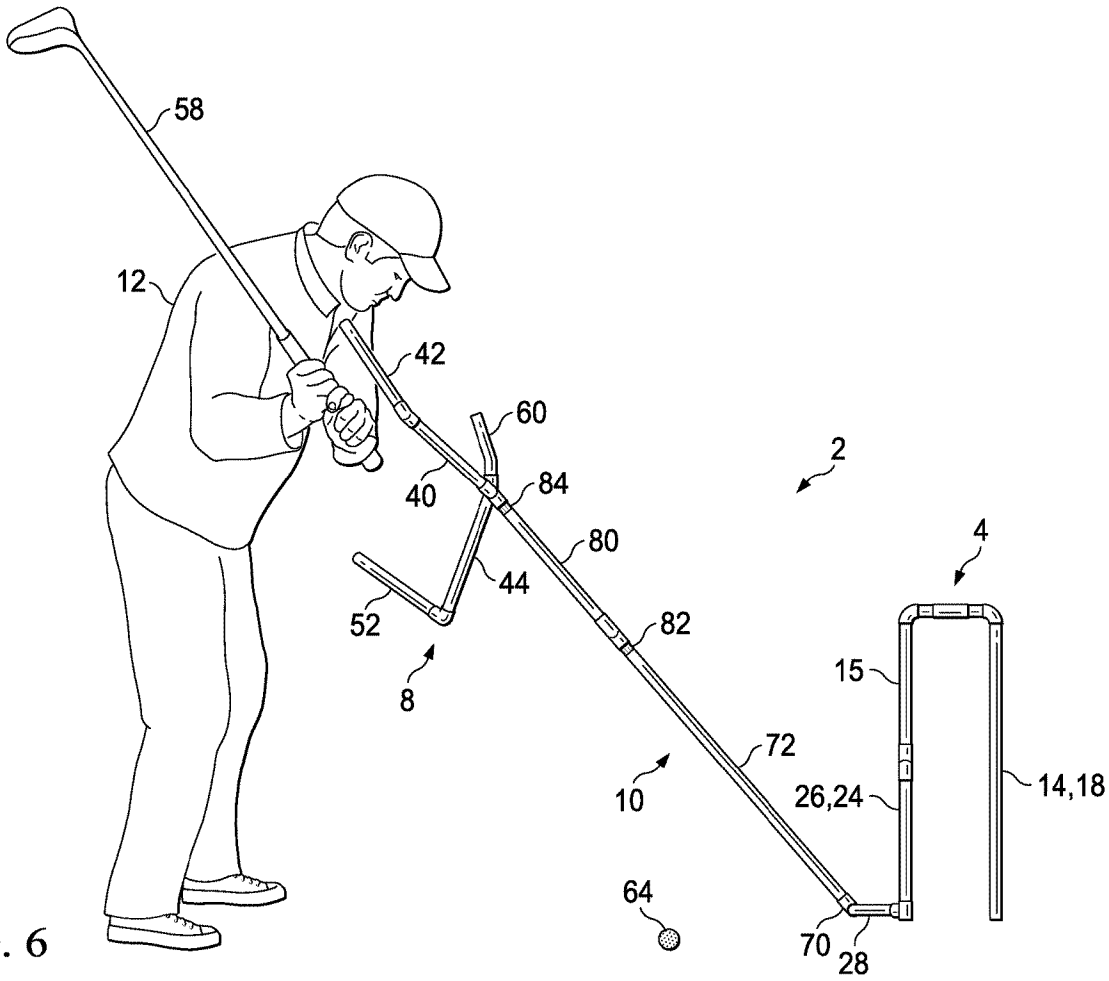
FIG. 6 is an elevational side view of the inventive 3-dimensional golf swing training apparatus 2.
Figure 7:
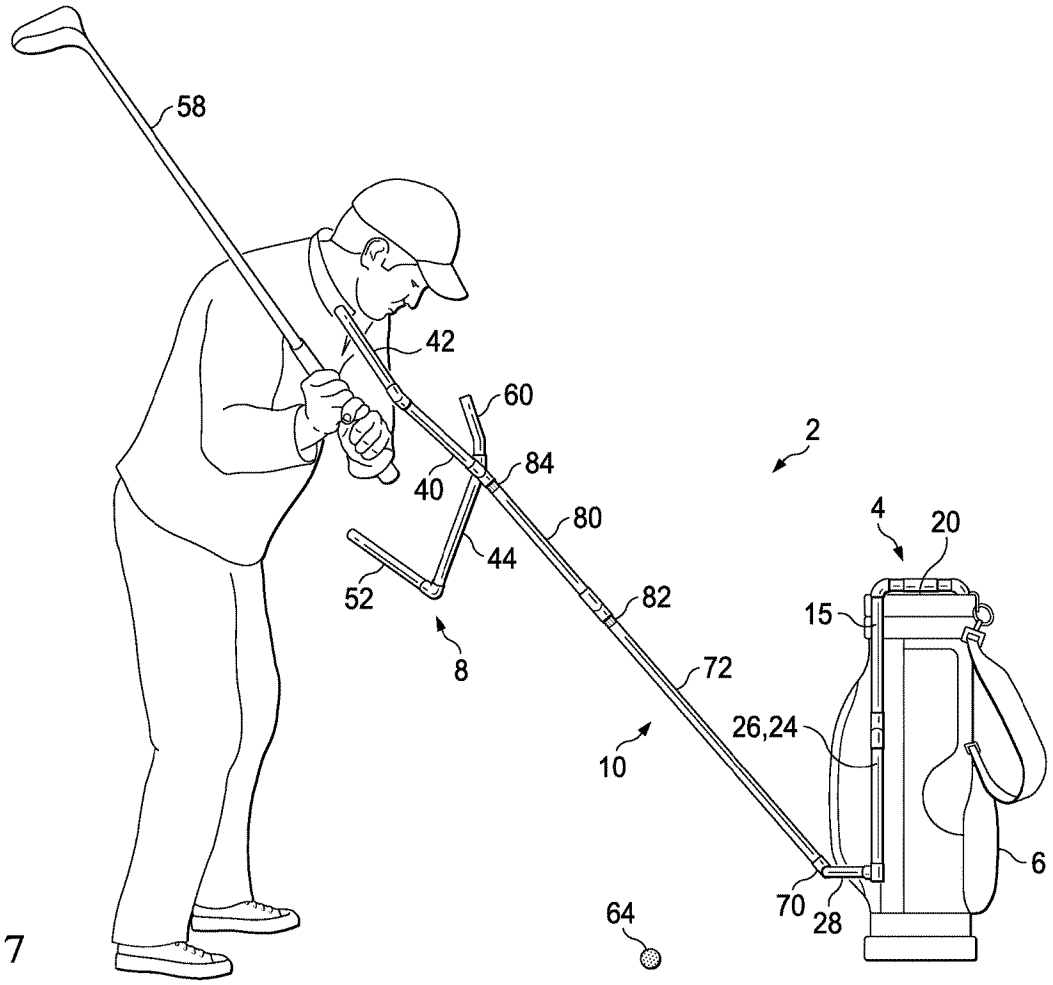
FIG. 7 is an elevational side view in which the inventive training apparatus 2 is positioned on and supported in suspended position by a golf bag 6.

As illustrated in FIGS. 1, 6, and 7, the base structure 4 is preferably a frame structure comprising a rear portion 14 and a front portion 15. The rear portion 14 preferably comprises a pair of substantially parallel, downwardly extending (preferably vertical) retaining rods, conduits, or other structures 16 and 18 which are insertable in the top opening 20 of the golf bag 6 for retaining the front portion 15 of the base structure 4 on the exterior of the golf bag 6 as illustrated in FIG. 7.

The front (i.e., exterior) portion 15 of the base frame structure 14 preferably comprises a pair of spaced apart frame structures 24 and 26 which extend downwardly from the top 24 of the bag 6 to near the bottom of the bag 6. The length of the downwardly extending exterior frame structures 24 and 26 is preferably at least ⅔, more preferably at least 70% or at least ¾, of the height of the golf bag 6. At least one frame cross member 28, preferably located at or near the bottom of the base frame structure 4, extends laterally between the bottom portions of the downwardly extending exterior frame structures 24 and 26. The exterior cross member 28 is preferably outwardly bowed or curved to correspond to and accommodate the outer curvature of the golf bag 6.

It will be understood, however, that although the base structure 4 has been shown and described as a frame structure which is positionable on a golf bag 6, the base structure 4 can alternatively be positioned on a weighted bucket or similar structure or can be a structure of any desired shape or configuration which has sufficient weight for supporting the inventive apparatus 2 in suspension when simply placed on a ground surface.

As seen in FIGS. 2-5 when deployed in elevated position by the support arm structure 10 in front of the golfer 12, the swing position training structure 8 preferably comprises a backswing/downswing portion 30 and a follow-through portion 32. The backswing/downswing portion 30 preferably comprises: a substantially horizontal segment 34 which extends outwardly from in front of the torso 35 of the golfer 12 to a point 36 (i.e., a distal end of the horizontal segment 34) on the backswing side 38 of the golfer 12; a backswing end portion 40 which angles or curves upwardly and rearwardly, with respect to the golfer 12, from the point 36 on the backswing side 38 of the golfer 12; and a swing guiding plane member 42 which extends upwardly, rearwardly and inwardly, with respect to the golfer 12, from the backswing end portion 40. The swing guiding plane member 42 on the backswing side 38 of the golfer 12 has a longitudinal axis 43.

As used herein and in the claims when describing the substantially horizontal segment 34 of the swing position training structure 8, the term "substantially horizontal" means horizontal or within ±10° of horizontal.

The follow-through portion 32 of the swing position training structure 8 preferably comprises (a) a first follow-through segment 44 which extends outwardly, downwardly, and rearwardly, with respect to the golfer 12, from the proximal end 46 of the substantially horizontal segment 34 to a point 48 on the follow-through side 50 of the golfer 12 and (b) a swing guiding plane member 52 which extends upwardly, rearwardly, and outwardly, with respect to the golfer 12, from the distal end 48 of the first follow-through segment 44. The swing guiding plane member 52 on the follow-through side 50 of the golfer 12 has a longitudinal axis 53 and is elevationally lower than the swing guiding plane member 42 on the backswing side 38 of the golfer 12.

The guiding plane member 42 on the backswing side 38, the guiding plane member 52 on the follow-through side 50, and the longitudinal axes 43 and 53 thereof extend in and together define a swing guiding plane 54 for the golfer 12. In addition, the guiding plane members 42 and 43 and the longitudinal axes 43 and 53 thereof are preferably substantially tangential to a club path guiding circle or oval 56 in the swing guiding plane 54.

As used herein and in the claims when describing the club path guiding circle or oval 56, the term "substantially tangential" means tangential or within f 100 of tangential.

It will also be understood that, during use, the swing position training structure 8 will preferably be positioned with respect to the golfer 12 such that the guiding plane members 42 and 52 as well as the swing path guiding plane 54 and the club path guiding circle or oval 56 defined by the guiding plane members 42 and 52, will preferably be spaced forwardly from the actual swing plane and path of the golfer's club 58 by a distance in the range of from about 3 to about 12 inches.

Figure 2:
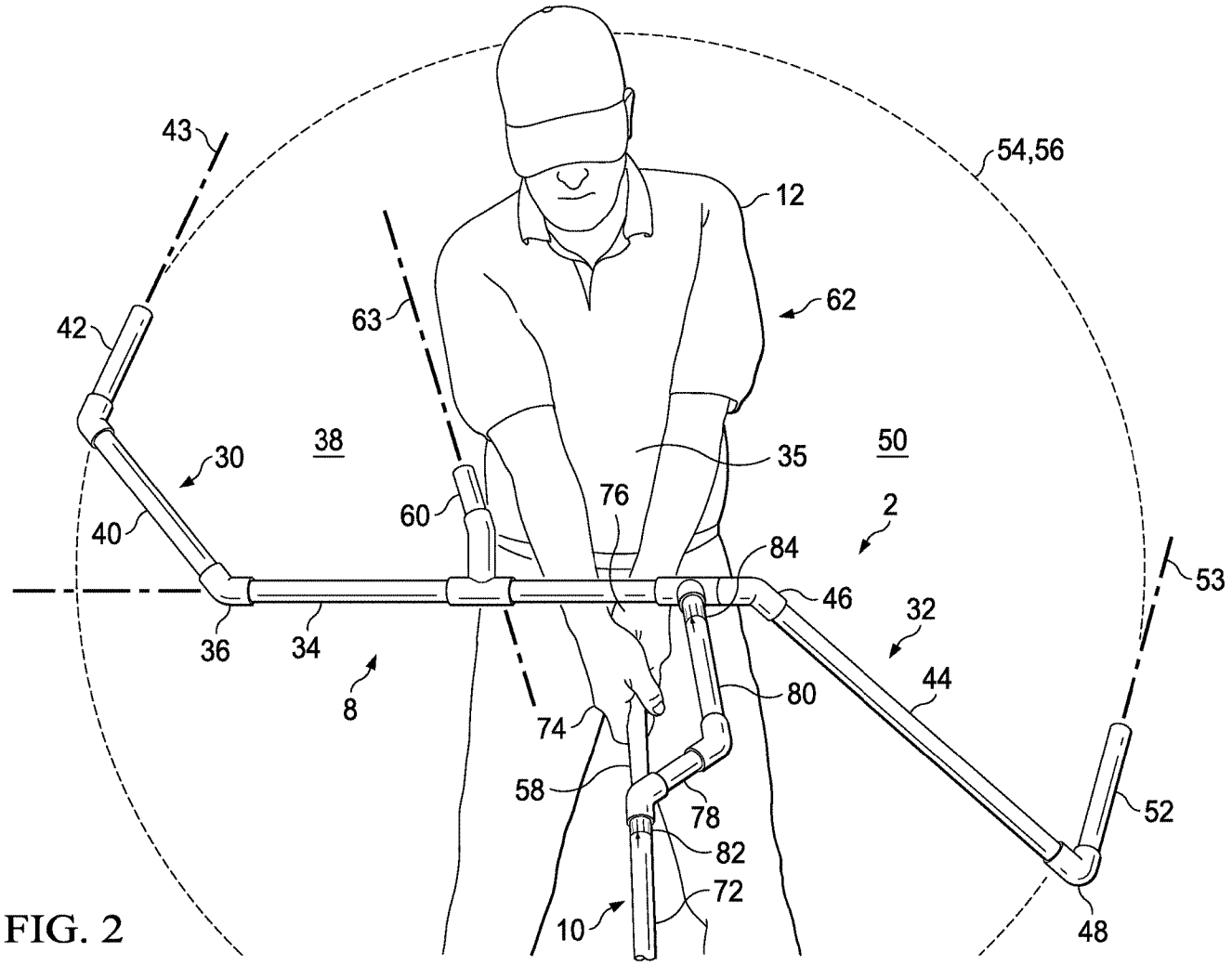
FIG. 2 is an elevational front view of the inventive apparatus 2 which illustrates a golfer 12 standing behind the apparatus 2 in a beginning stance 62.

The backswing/downswing portion 30 of the swing position training structure 8 preferably also comprises a club alignment structure 60 which preferably is mounted on or extends from an intermediate portion of the horizontal segment 34 of the training structure 8 such that the club alignment structure 60 is preferably located substantially at (i.e., at or within±4 inches of) the side (i.e. the backswing side 38) of the golfer's torso 35 when the golfer 12 is in the beginning stance 62 as illustrated in FIG. 2. The club alignment structure 60 preferably extends upwardly, rearwardly and outwardly with respect to the golfer 12 and is preferably rotatably mounted on the horizontal segment 34 so that the longitudinal axis 63 of the club alignment structure 60 can be aligned with the golf ball 64 which is resting on the ground surface in front of the golfer 12.

Figure 3:
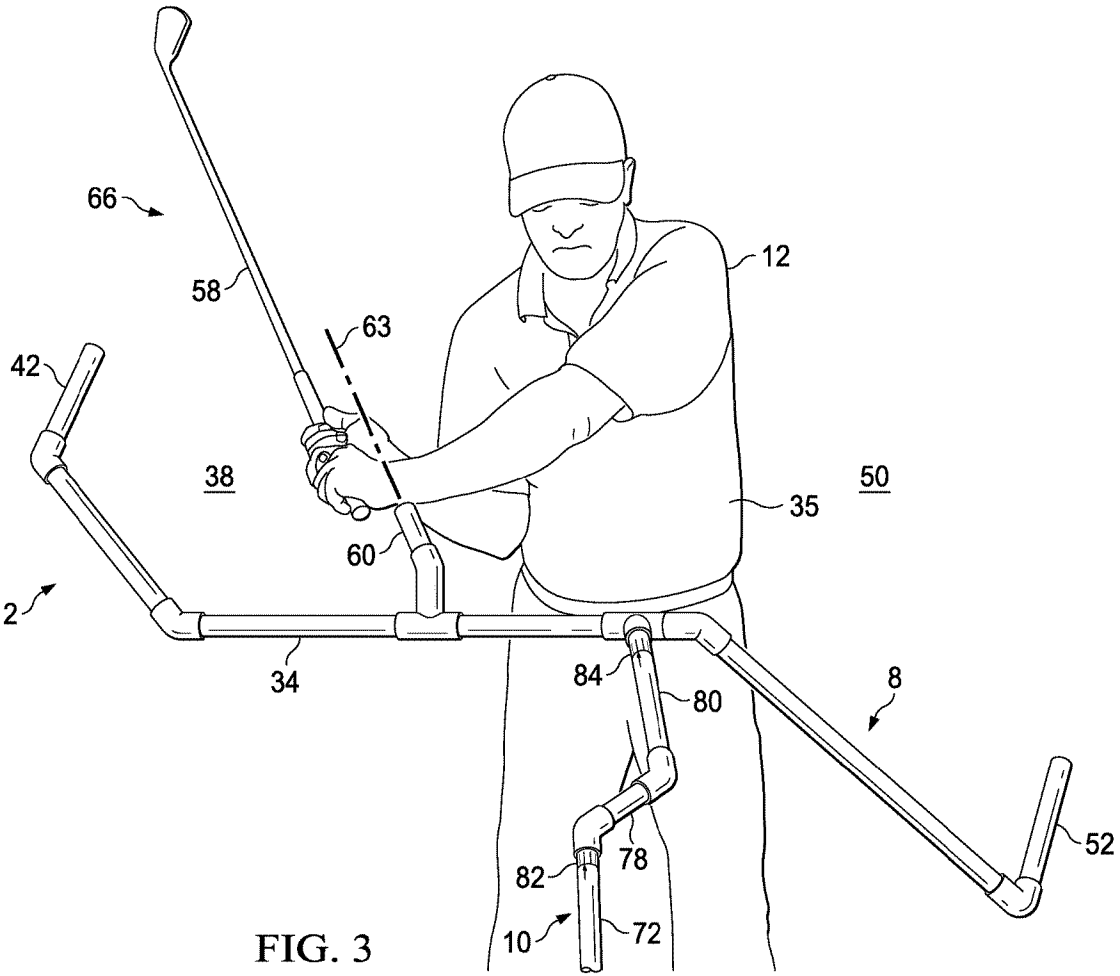
FIG. 3 is an elevational front view of the inventive apparatus 2 in which the golfer 12 has now reached an upper intermediate downswing position 66 of the golfer's swing.
Figure 4:
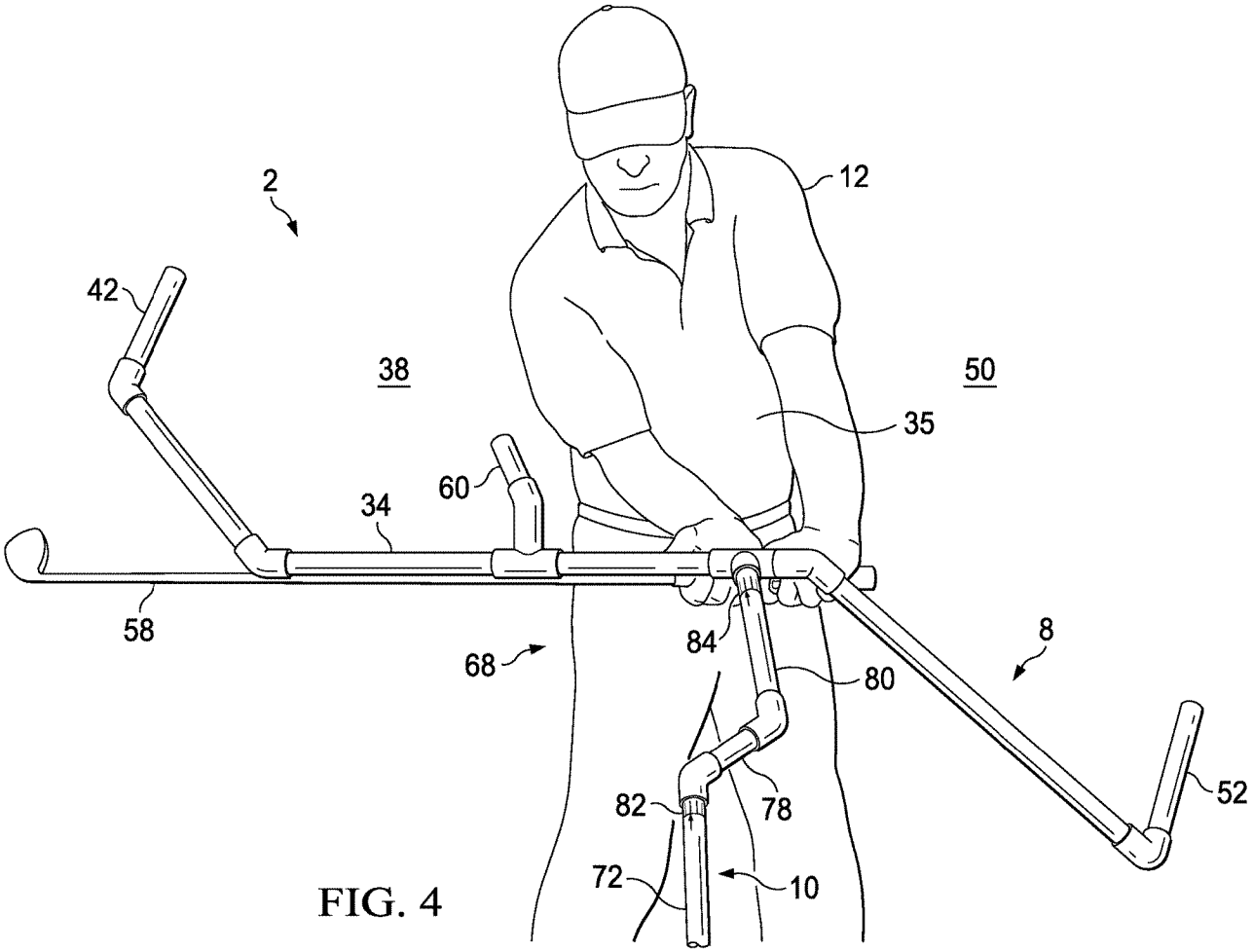
FIG. 4 is an elevational front view of the inventive apparatus 2 in which the golfer 12 has now reached a lower intermediate downswing position 68 of the golfer's swing.

The club alignment structure 60 is for aligning the club 58 held by the golfer 12 at an upper intermediate position 66 of the golfer's downswing as illustrated in FIG. 3. As the downswing continues, the golfer's club 58 will subsequently by aligned with the horizontal segment 34 of the swing training structure 8 when the golfer 12 reaches the lower intermediate downswing position 68 illustrated in FIG. 4.

The proximal end 70 of the support arm structure 10 which holds the swing position training structure 8 in an elevated position in front of the golfer 12 is preferably pivotably attached to exterior cross member 28 of the frame base structure 14 for raising or lowering the swing position training structure 8 to accommodate the height of the golfer 12 and/or the length of the particular club 58 which the golfer 12 has elected to use. In addition, the pivotable attachment of the support arm structure 10 allows the arm 10 to be folded up against or adjacent to the base structure 14 for storage or transport, or for carrying the inventive portable apparatus 2 to a new location.

The support arm structure 10 of the inventive swing training apparatus 2 preferably comprises a straight lower portion 72 which extends upwardly at an angle toward the center of the golfer's torso 35 when the golfer 12 is in the beginning stance 62 illustrated in FIG. 2. This allows the lower portion 72 of the arm structure 10 to be used as an alignment structure for the golfer's hands 74 and 76 and club 58 when the golfer is in the beginning stance 62.

The support arm structure 10 preferably also comprises (a) an angled intermediate segment 78 which angles or curves outwardly from the distal end of the straight lower portion 72 and (b) an upper segment 80 which preferably extends from the distal end of the angle intermediate segment 78 of the arm structure 10 to the horizontal segment 34 of the training structure 8 such that the upper segment 80 of the support arm structure 10 is substantially perpendicular to (i.e., perpendicular or within ±10° of perpendicular to) the horizontal segment 34.

The angled intermediate segment 78 of the support arm structure 10 provides an open area 82 through which the golfer's view of the golf ball 64 is not obstructed by the arm structure 10. Also, the angled intermediate segment 78 of the support arm structure 10 is preferably rotatably attached to the distal end of the lower portion 72 so that, by rotating the angled intermediate segment 78, the height of the elevated swing position training structure 8 can be raised or lowered as needed when switching to a different club 58 which is longer or shorter in length, and/or to accommodate the height of the golfer. To assist in the adjustment process, a dial or other indicia 82 can be provided at the point of rotation between the angled intermediate segment 78 and the lower portion 72 of the support arm structure 10 for repeatably matching the rotational position of the angled intermediate segment 78 with any desired set clubs 58.

In addition, the swing position training structure 8 is preferably rotatably attached to the distal end of the upper segment 80 of the support arm structure 10. This allows the training structure 8 to be leveled or otherwise adjusted as needed whenever the height of the training structure 8 has been changed by rotating the angled intermediate segment 78. If desired, a dial or other indicia 84 can also be provided at the point of rotation of the training structure 8 for matching the orientation of the training structure 8 with the rotational position of the angled segment 78 and/or the particular club selected.

Figure 5:
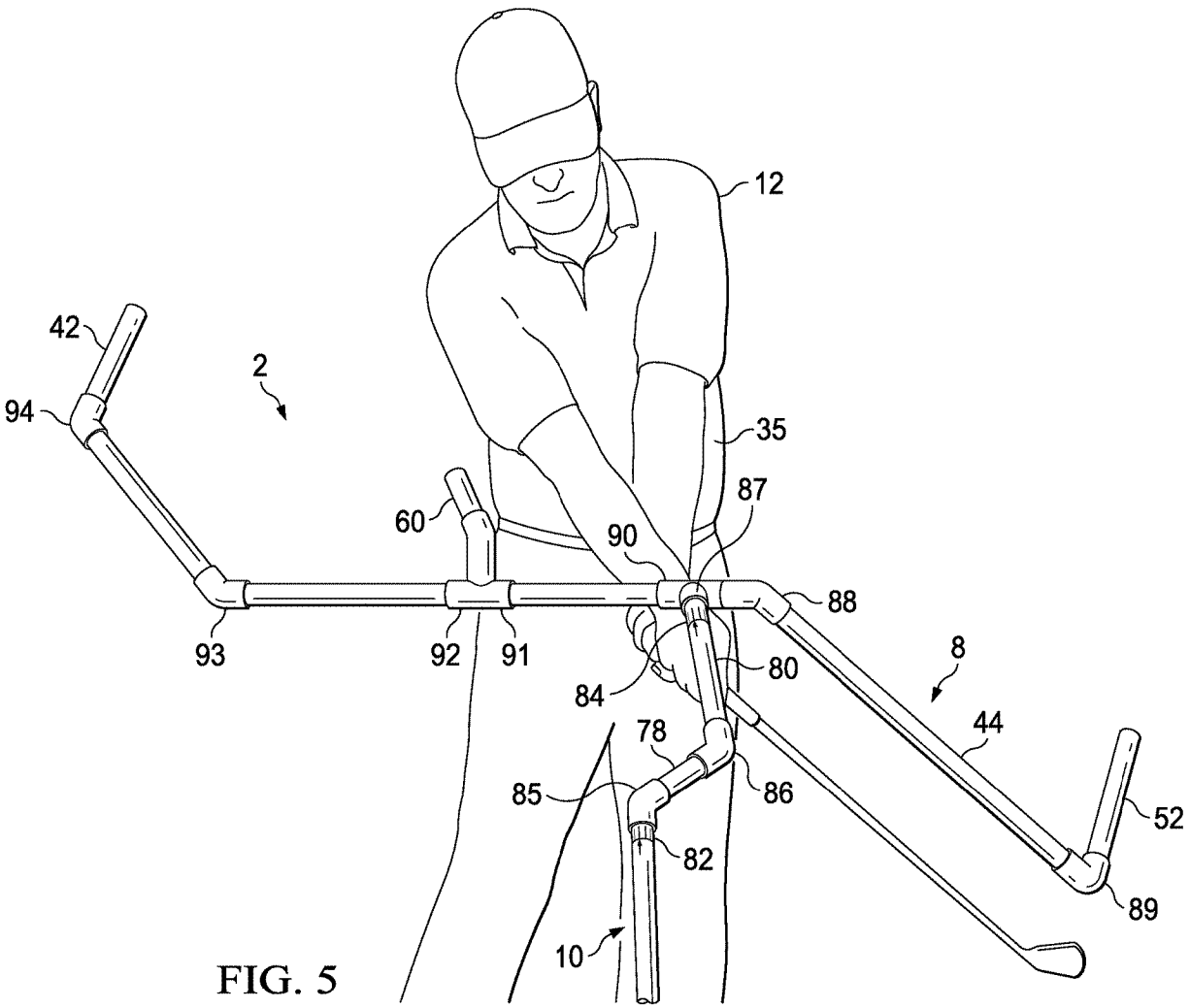
FIG. 5 is an elevational front view of the inventive apparatus 2 in which the golfer 12 has reached the follow-through stage of the golfer's swing.

The various pieces of the swing position training structure 8 and the support arm structure 10 will preferably be rotatable and disconnectable at some or all of points 85, 86, 87, 88, 90, 91, 92, 93, and 94 shown in FIG. 5. This allows the elevated training structure 8 of the inventive apparatus 2 to be removed and disassembled for storage, or for carrying from one location to another, and also allows the swing position training structure 8 to be reassembled in a mirror image configuration for use by a left handed golfer.

Thus, the present invention is well adapted to carry out the objects and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within this invention as defined by the claims.

What is claimed:

1. A golf swing training apparatus comprising:

a base structure positionable on a golf bag such that at least a portion of the base structure is on an exterior of the golf bag;

a swing position training structure; and a support arm structure extending from the base structure to the swing position training structure which holds the swing position training structure in an elevated position for use, wherein the swing position training structure comprises first and second guiding plane members which extend in and define a swing guiding plane for a golfer who is positioned behind and facing the swing position training structure, wherein the first guiding plane member extends upwardly and rearwardly, with respect to the golfer, on a backswing side of the golfer and the second guiding plane member extends upwardly and rearwardly, with respect to the golfer, on a follow-through side of the golfer.

2. The golf swing training apparatus of claim 1 wherein a proximal end of the support arm structure is pivotably attached or attachable to the base structure for raising and lowering the elevated position of the swing position training structure.

3. The golf swing training apparatus of claim 1 wherein the base structure further comprises one or more retaining structures which are insertable into a top opening of the golf bag for retaining the base structure on the golf bag.

4. The golf swing training apparatus of claim 1 wherein the swing position training structure is detachably connectable to a distal end portion of the support arm structure.

5. The golf training apparatus of claim 1 wherein:

the first guiding plane member is elevationally higher than the second guiding plane member;

the first guiding plane member is-angled toward the golfer; and the second guiding plane member is angled away from the golfer.

6. The golf swing training apparatus of claim 5 wherein the first and the second guiding plane members are substantially tangential to and define a club path guiding circle or oval in the swing guiding plane.

7. The golf swing training apparatus of claim 1 wherein the swing position training structure comprises a substantially horizontal segment which is a club alignment structure for a lower intermediate downswing position.

8. The golf swing training apparatus of claim 1 wherein the support arm structure includes a straight portion which is an alignment structure for the hands of a golfer and a club held by the golfer when the golfer is in a beginning stance.

9. A golf swing training apparatus comprising:

a base structure positionable on a golf bag such that at least a portion of the base structure is on an exterior of the golf bag;

a swing position training structure;

a support arm structure extending from the base structure to the swing position training structure which holds the swing position training structure in an elevated position for use;

the swing position training structure includes a club alignment structure on a backswing side of a golfer who is positioned behind and facing the swing position training structure;

the club alignment structure is for aligning a club held by the golfer at an upper intermediate downswing position; and the club alignment structure extends at upward, rearward, and outward angles with respect to the golfer such that the club alignment structure is substantially in alignment with a golf ball on a ground surface in front of the golfer.

* * * * *